US007674056B2

(12) United States Patent
Shaw et al.

(10) Patent No.: US 7,674,056 B2
(45) Date of Patent: Mar. 9, 2010

(54) PAPER PATH POWERED JAM/LOCK SYSTEMS AND METHODS

(75) Inventors: Timothy C. Shaw, Portland, OR (US); Daniel C. Park, West Linn, OR (US); Rich Chambers, Portland, OR (US); Darryl I. Jensen, Woodburn, OR (US); Jos Jacobs, Sherwood, OR (US); Danielle R. Hall, Sherwood, OR (US); David B. Schaefer, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 916 days.

(21) Appl. No.: 11/373,384

(22) Filed: Mar. 10, 2006

(65) Prior Publication Data

US 2007/0212154 A1 Sep. 13, 2007

(51) Int. Cl.
*B41J 13/08* (2006.01)

(52) U.S. Cl. ..... 400/637; 400/637.1

(58) Field of Classification Search ..... 400/637.1, 400/637

See application file for complete search history.

(56) References Cited

U.S. PATENT DOCUMENTS

| | | | | |
|---|---|---|---|---|
| 4,438,917 | A | 3/1984 | Janssen et al. | |
| 4,971,304 | A | 11/1990 | Lofthus | |
| 5,169,140 | A | 12/1992 | Wenthe, Jr. | |
| 5,221,035 | A * | 6/1993 | Suzuki et al. | 226/181 |
| 5,278,624 | A | 1/1994 | Kamprath et al. | |
| 5,678,159 | A | 10/1997 | Williams et al. | |
| 6,032,004 | A | 2/2000 | Mirabella, Jr. et al. | |
| 7,434,928 | B2 * | 10/2008 | Dohki | 347/104 |
| 2002/0043950 | A1 | 4/2002 | Yim et al. | |
| 2002/0097427 | A1 | 7/2002 | Kazama | |
| 2003/0169046 | A1 * | 9/2003 | Morris | 324/409 |
| 2003/0209303 | A1 * | 11/2003 | Bretl et al. | 156/64 |
| 2005/0150992 | A1 * | 7/2005 | Morris et al. | 242/563 |
| 2005/0189698 | A1 | 9/2005 | Somemiya | |

* cited by examiner

*Primary Examiner*—Anthony H. Nguyen
(74) *Attorney, Agent, or Firm*—Gibb I.P. Law Firm, LLC

(57) ABSTRACT

An image output device includes a marking engine and a media path adjacent the marking engine. The media path has a media transportation direction and a media transport element (e.g., a nip drive, a belt drive, a suction drive, an air pressure drive, etc.) within the media path that moves the media along the media path in the media transportation direction. A drive motor is operatively connected to the media transport element. The drive motor provides drive force in a forward direction that causes the media transport element to move media along the media path in the media transportation direction. The drive motor can also provide the drive force in a reverse direction opposite the forward direction. A one-way drive transfer device (e.g., a one-way clutch, a one-way swing arm mechanism, etc.) is operatively connected to the drive motor. The one-way drive transfer device only transfers drive force from the drive motor when the drive motor operates in the reverse direction. The reverse direction drive of the motor, in conjunction with a one-way drive transfer device, can be used to perform the lock/unlock or the open/close of a jam clearance mechanism, baffle, or shield.

15 Claims, 10 Drawing Sheets

PAPER PATH POWERED JAM/LOCK SYSTEMS AND METHODS

BACKGROUND

Embodiments herein generally relate to paper path baffles that open and close to allow jam clearance access. Such devices often have handles/latches that are used to lock and unlock the baffles. The baffles may need to be locked to prevent improper user access, to support nip loading contained in the baffles, or for other reasons. These handles/latches are usually operated via physical interaction from the user to lock and unlock the mechanism. For example, when a jam in printer is declared, the user is directed to unlatch and open the baffle in the jam region.

Conventional access to the jam clearance areas of a media path drive has been achieved by manually opening or removing portions of paper path baffles. Alternatively, portions of media path baffles could be opened automatically using a dedicated motor or other actuator to achieve the opening motion. For instance, a dedicated motor may be used to rotate a jam clearance mechanism that pivots open to allow customer access to the media path. Automatic opening can be useful for letting the customer know where to clear a jam without confusing knobs or handles and for allowing uncomfortably hot media path baffles to cool prior to customer jam clearance.

SUMMARY

Because a nip drive motor can be used to only drive the nip in a single forward direction, a baffle locking mechanism according to embodiments herein can be driven using the reverse motion of the nip drive. This structure/method allows the baffle latch system/lock to be changed from the locked state to the un-locked state (or vice versa) any time the nip drive would otherwise be inactive. A one-way roller clutch or a swing arm apparatus is utilized in order to drive the baffle lock mechanism during nip drive motor reverse operations. During forward drive motor operations, the roller clutch or swing arm prevents the baffle lock mechanism from being operated, or a spring loaded detent can be used to hold the latch system in a locked state, such that normal nip drive is achieved without disturbing the state of the baffle lock mechanism.

Further, when the nip drive motor is only used to drive the nip in a single forward direction, a jam clearance mechanism or baffle according to embodiments herein is driven using the reverse motion of the nip drive. This structure/method allows the jam clearance mechanism or baffle to be changed from the closed state (for media transport) to the open state any time the nip drive would otherwise be inactive. A one-way roller clutch or a swing arm apparatus is utilized in order to drive the nip release mechanism during nip drive motor reverse operation. During forward drive motor operations the roller clutch or swing arm prevents the jam clearance mechanism from being driven, such that normal nip drive is achieved without disturbing the state of the jam clearance release mechanism.

More specifically, embodiments herein comprise an image output device such as a printer, copier, facsimile machine, multifunction device, etc. that includes a marking engine and a media path adjacent the marking engine. The media path has a media transportation direction and a media transport element (e.g., a nip drive, a belt drive, a suction drive, an air pressure drive, etc.) within the media path that moves the media along the media path in the media transportation direction. A drive motor is operatively connected to the media transport element. The drive motor provides drive force in a forward direction that causes the media transport element to move media along the media path in the media transportation direction. The drive motor can also provide the drive force in a reverse direction opposite the forward direction. A one-way drive transfer device (e.g., a one-way clutch, a one-way swing arm mechanism, etc.) is operatively connected to the drive motor. The one-way drive transfer device only transfers drive force from the drive motor when the drive motor operates in the reverse direction.

In one embodiment, the media path can include an access element (e.g., a movable baffle, a movable media guide, a movable tray, a movable shield, a movable media jam clearance mechanism, etc.) operatively connected to the one-way drive transfer device. Such an access element can allow the media to be removed from an interior of the media path (e.g., a location between the beginning and end of the media path). When the access element is closed, the media can move along the media path, and when the access element is open, the media potentially cannot move along the media path. When the drive motor operates in the reverse direction, the one-way drive transfer device causes the access element to open and/or close, thereby eliminating the need for a separate actuator to move the access element. In alternative embodiments, the one-way drive transfer device can cause the access element to lock and/or unlock. In a further embodiment, when the drive motor operates in the reverse direction, the one-way drive transfer device can simultaneously cause the access element and a movable shield to open and/or close.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, when a nip drive motor is used to only drive the nip in a single forward direction, a baffle locking mechanism according to embodiments herein can be driven using the reverse motion of the nip drive. This structure/method allows the baffle latch system/lock to be changed from the locked state to the un-locked state (or vice versa) any time the nip drive would otherwise be inactive. A one-way roller clutch or a swing arm apparatus is utilized in order to drive the baffle lock mechanism during nip drive motor reverse operations. During forward drive motor operations, the roller clutch or swing arm prevents the baffle lock mechanism from being operated, or a spring loaded detent can be used to hold the latch system in a locked state, such that normal nip drive is achieved without disturbing the state of the baffle lock mechanism.

The drawings accompanying this application illustrate just a few of the many different structures in which the embodiments herein can operate. One ordinarily skilled in the art would understand that the claims encompass the illustrated structures as well as any other devices that lock/unlock or open/close media paths by reverse operation of the drive motor, regardless of whether or not the alternative devices include a common structure to the ones shown in the attached drawings.

Figure 1:
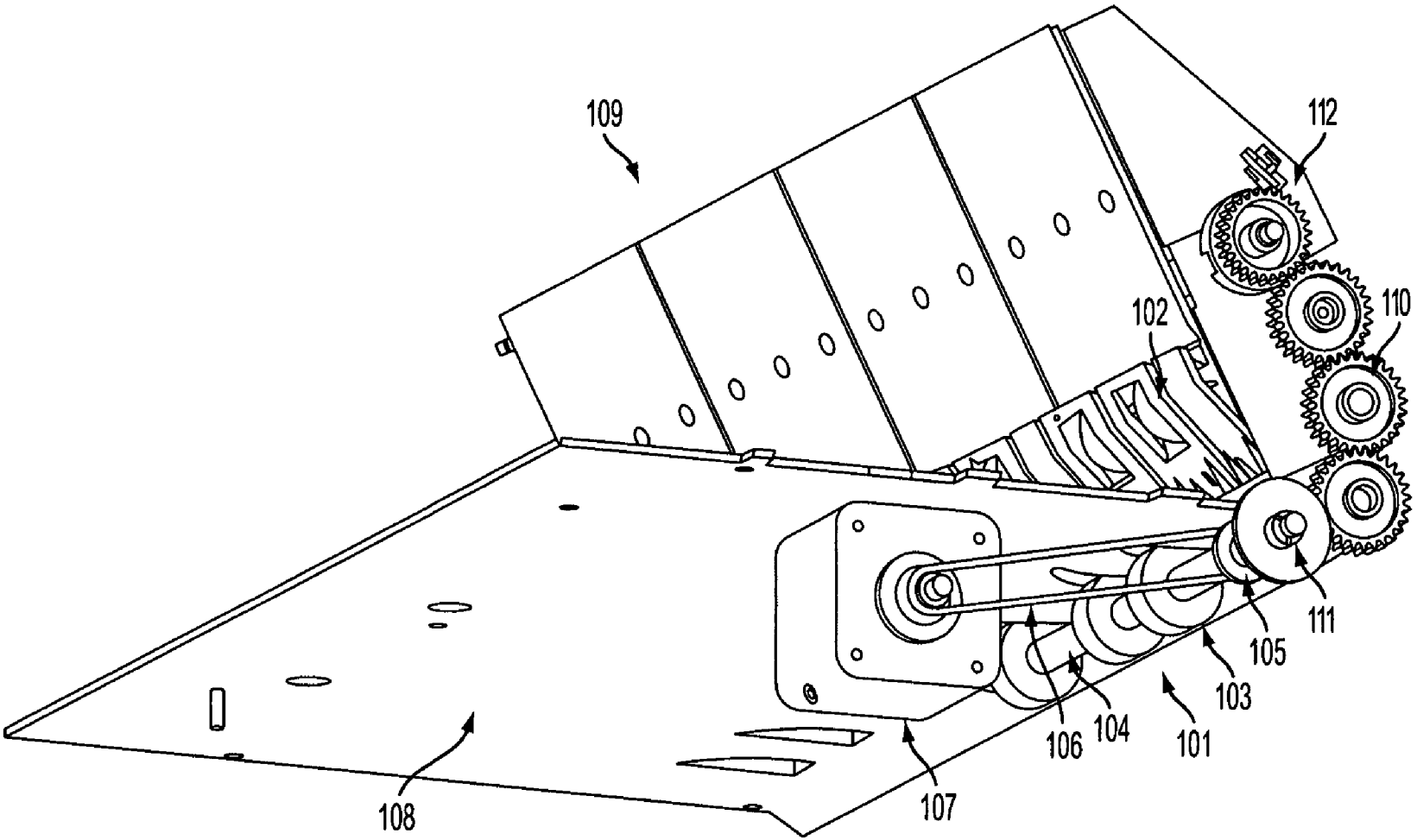
FIG. 1 is a schematic perspective representation of a locking mechanism according to embodiments herein.
Figure 2:
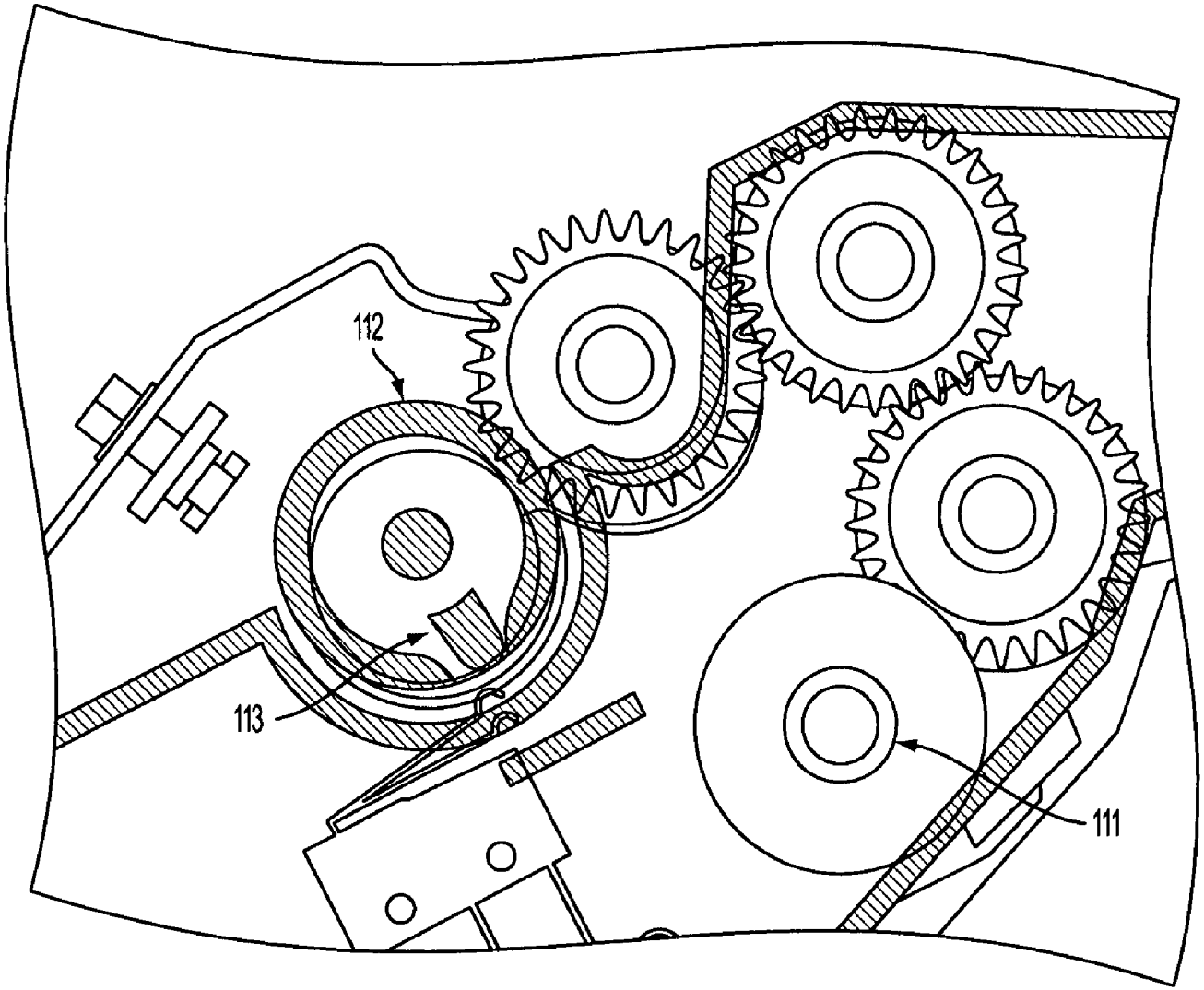
FIG. 2 is a schematic close-up perspective representation of a locking mechanism according to embodiments herein.
Figure 3A:
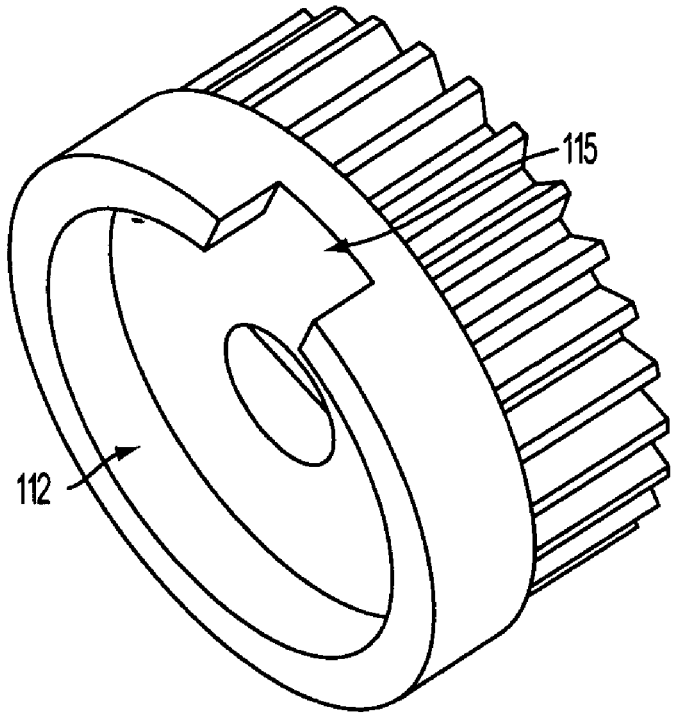
FIGS. 3*a*-3*c* are schematic perspective representations of a locking mechanism according to embodiments herein.
Figure 3B:
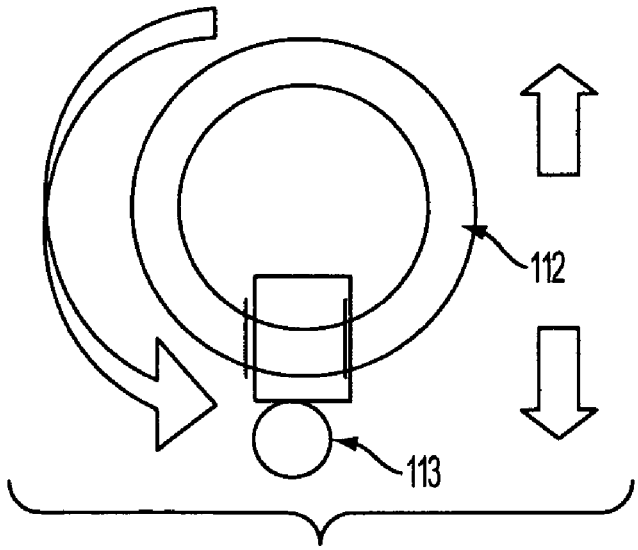
Figure 3C:
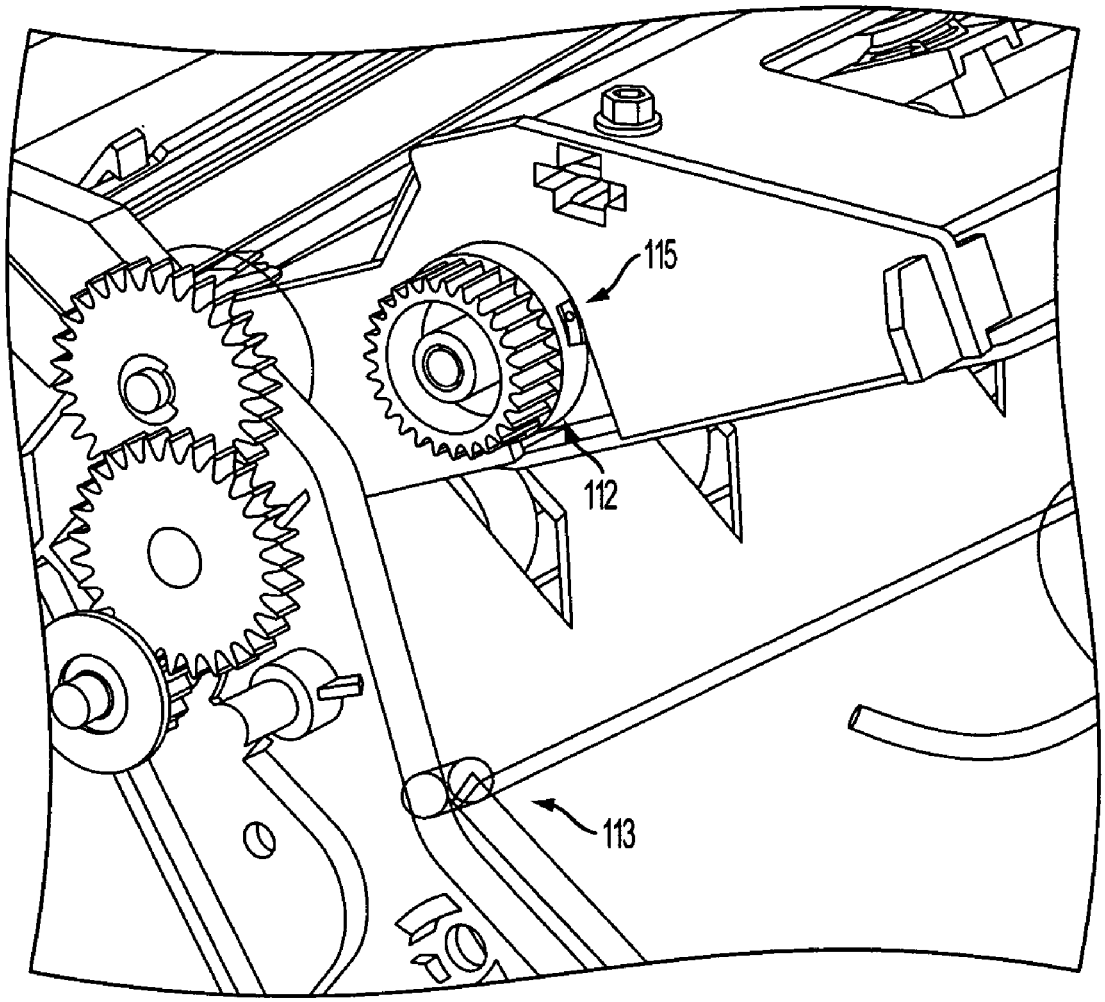

Referring now to FIG. 1, contact between a drive roller (101) and an idler roller (102) form a media drive nip. The drive roller is part of the drive roller assembly (103), which also includes a shaft (104) and a drive pulley (105). The drive roller assembly is driven by a timing belt (106), which in turn is driven by a motor assembly (107) with an attached pulley. Alternatively, the drive roller assembly could be driven by a geartrain or could be directly attached to the drive motor. A media path is formed by a lower baffle (108) and an upper baffle (109). FIG. 1 shows the baffles in an opened position.

The upper baffle (109) is used for jam clearance functionality; it may or may not also contain idler rollers that bear against drive roller assembly (103). The upper jam clearance baffle (109) pivots about a pin joint (110). The constraint at the pin joint is not shown. The embodiments herein may be easily implemented with alternate baffle openings, as would be understood by one ordinarily skilled in the art, and the illustrations discussed herein are only examples that aid in the understanding of the invention In this exemplary embodiment, a baffle lock mechanism is achieved via a cam lock gear (112); although one ordinarily skilled in the art would understand that any form of locking mechanism or means could be utilized. The cam lock gear (112) allows the locking and unlocking of the upper baffle (109) by capturing a boss feature (113) on the lower frame, as shown in FIG. 2 and FIGS. 3*a*-3*c*. The cam lock gear (112) has a functional inside thrust surface with a slot feature to allow introduction of the lower chassis boss feature (113) into the functional region of the cam lock gear. Therefore, when the cam lock gear (112) is rotated through varying degrees of rotation, the baffle is locked or unlocked. Further, the embodiments herein find additional usefulness because the drive motor is used to operate a nip loading camshaft. In this case, the cam lock gears described above is integrated into the nip loading camshaft, such that the reverse motion of the same drive motor can be used to control nip loading as well as locking/unlocking of the jam clearance mechanism.

The cam lock gear (112) is driven via a one-way clutched idler gear (111) through a series of idlers gears. One-way clutches are known and are described in U.S. Patent Publications 2002/0097427 and 2002/0043950, the complete disclosures of which are incorporated herein by reference. The one-way clutch is oriented such that forward rotation of the drive roller (in the media drive direction) does not act on gear (111), but rather acts as a roller bearing. Reverse rotation of the drive roller will lock the roller clutch such that the gear (111) is driven in order to open the cam lock gear (112). Different methods and means may be used to only operate the jam clearance mechanism (110) when the motor is driven in reverse (such as a swing arm mechanism) and one ordinarily skilled in the art would understand that any form of one-way drive mechanism or means could be utilized. U.S. Patent Publication 2005/0189698, the complete disclosure of which is incorporated herein by reference, discusses aspects of swing arm mechanisms for example.

Figure 4A:
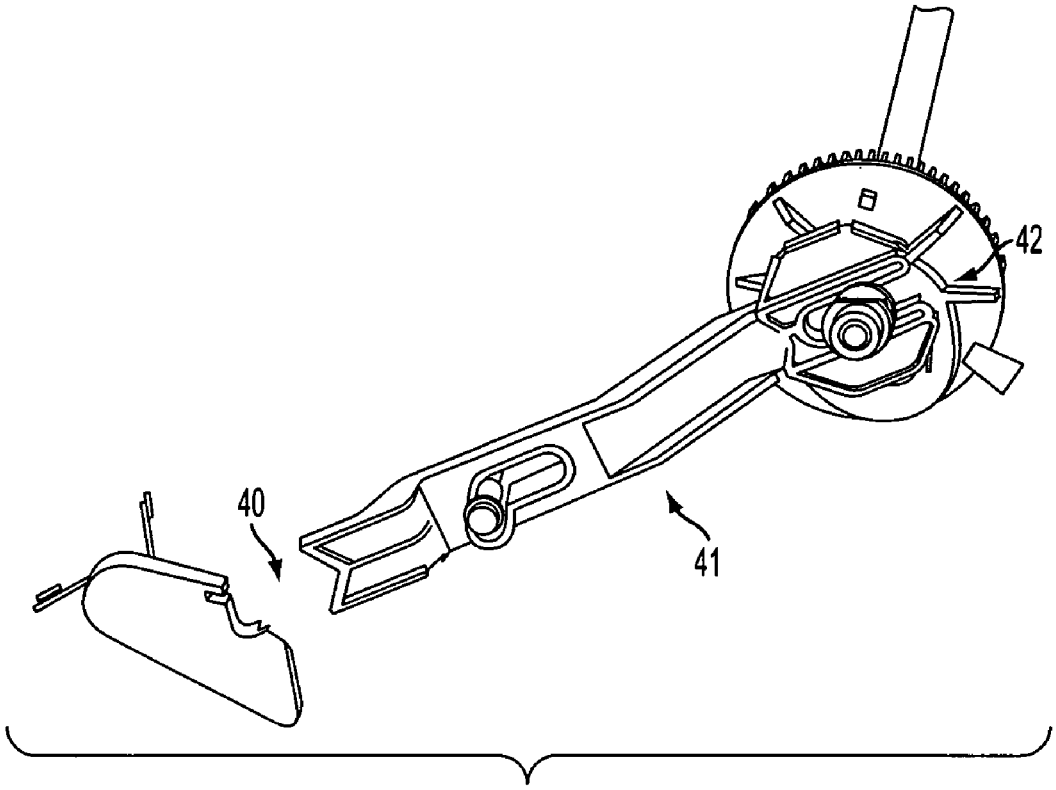
FIGS. 4*a*-4*d* are schematic perspective representations of a locking mechanism according to embodiments herein.

Another example of a lock is shown in FIGS. 4*a*-4*d*. Once again, one ordinarily skilled in the art would understand that any form of locking mechanism or means could be utilized with the embodiments herein and the structure shown in FIGS. 4*a*-*d* is merely another example of an application of how the embodiments herein can be applied. FIG. 4*a* shows a latch arm that runs in a cam and slot. The latch arm (41) slides forward and back depending on the position of the latch cam (42). When the shaft on the baffle assembly is brought up into position, the cam will rotate and bring the latch arm forward. The latch arm has forks (40) that guide the shaft into a locked position.

Figure 4B:
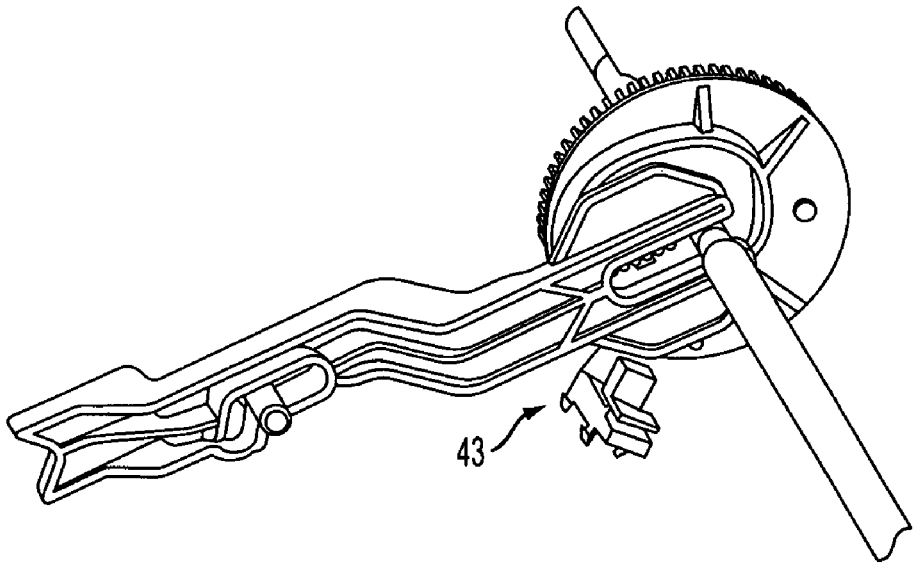
Figure 4C:
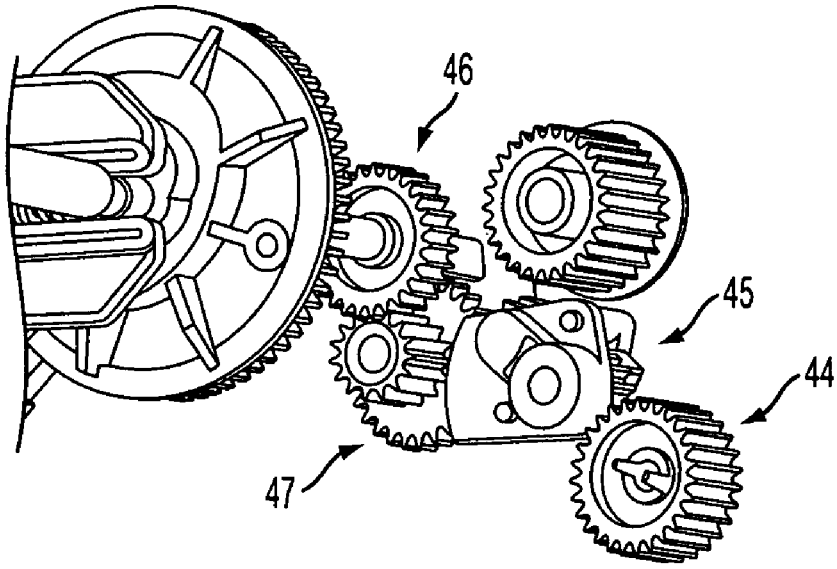
Figure 4D:
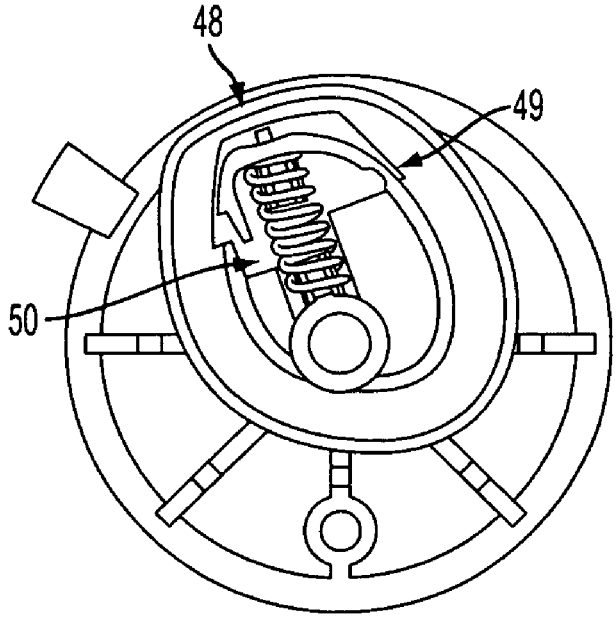

The drive power to turn the cam can come from any source, such as a media path motor that normally drives paper path rollers. The gear (44) that is connected to the motor is shown in FIG. 4*c*. The motor gear drives a swing arm (45) that can either drive the paper path gears or drive the compound gear (47). The compound gear engages the camshaft through a drive gear (46). The cam that the latch arm runs in is shown in FIG. 4*d*. The cam has a compliant section that spring loads the latch arms into the baffle shaft when in the locked position. The compliant section pivots about a "living hinge", a thin section of plastic (49). Spring load is provided by a coil spring (50) installed into the cam. A detent section (48) in the cam, when in the locked position, is provided to hold the system stationary, when not in use. FIG. 4*b* is an image of the sensor and flag on the cam. The sensor (43) is provided to give feedback to know the position of the cam (locked or unlocked).

Figure 5:
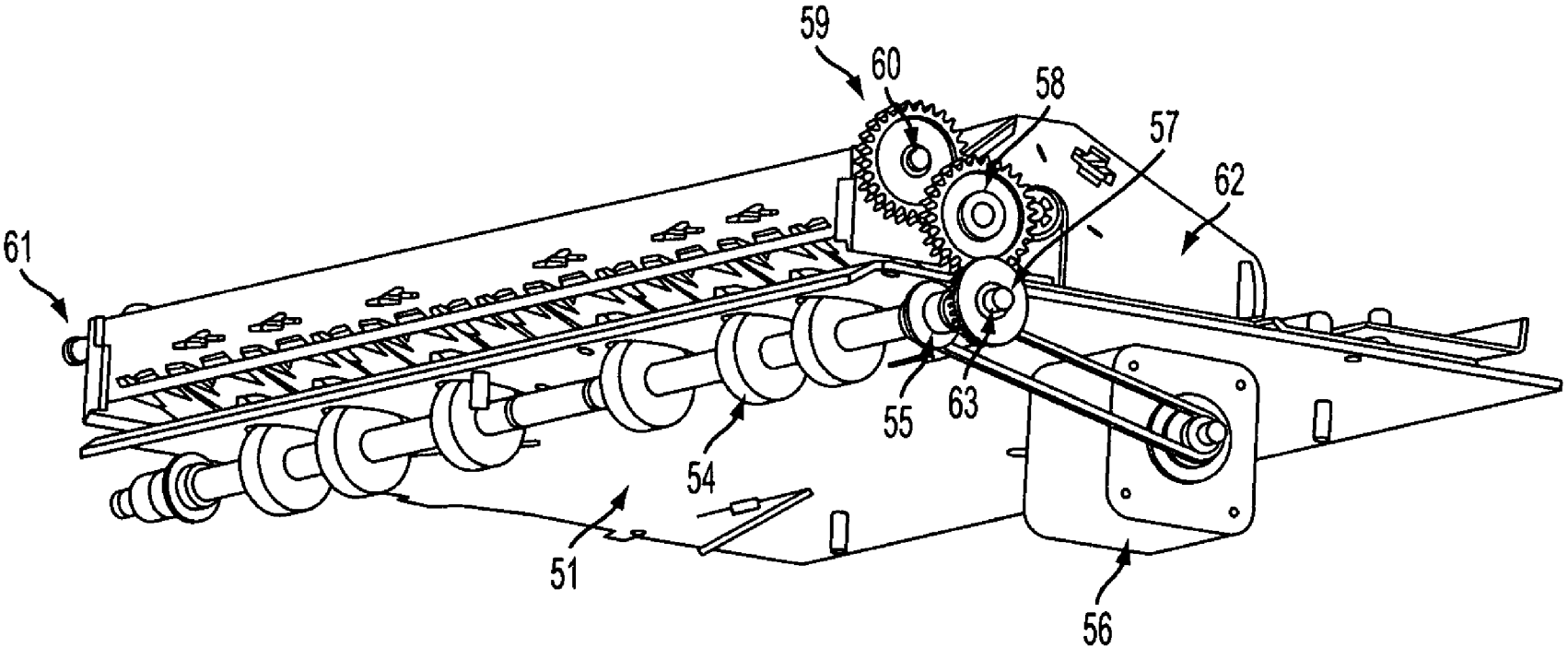
FIG. 5 is a schematic perspective representation of an opening/closing mechanism according to embodiments herein.
Figure 6:
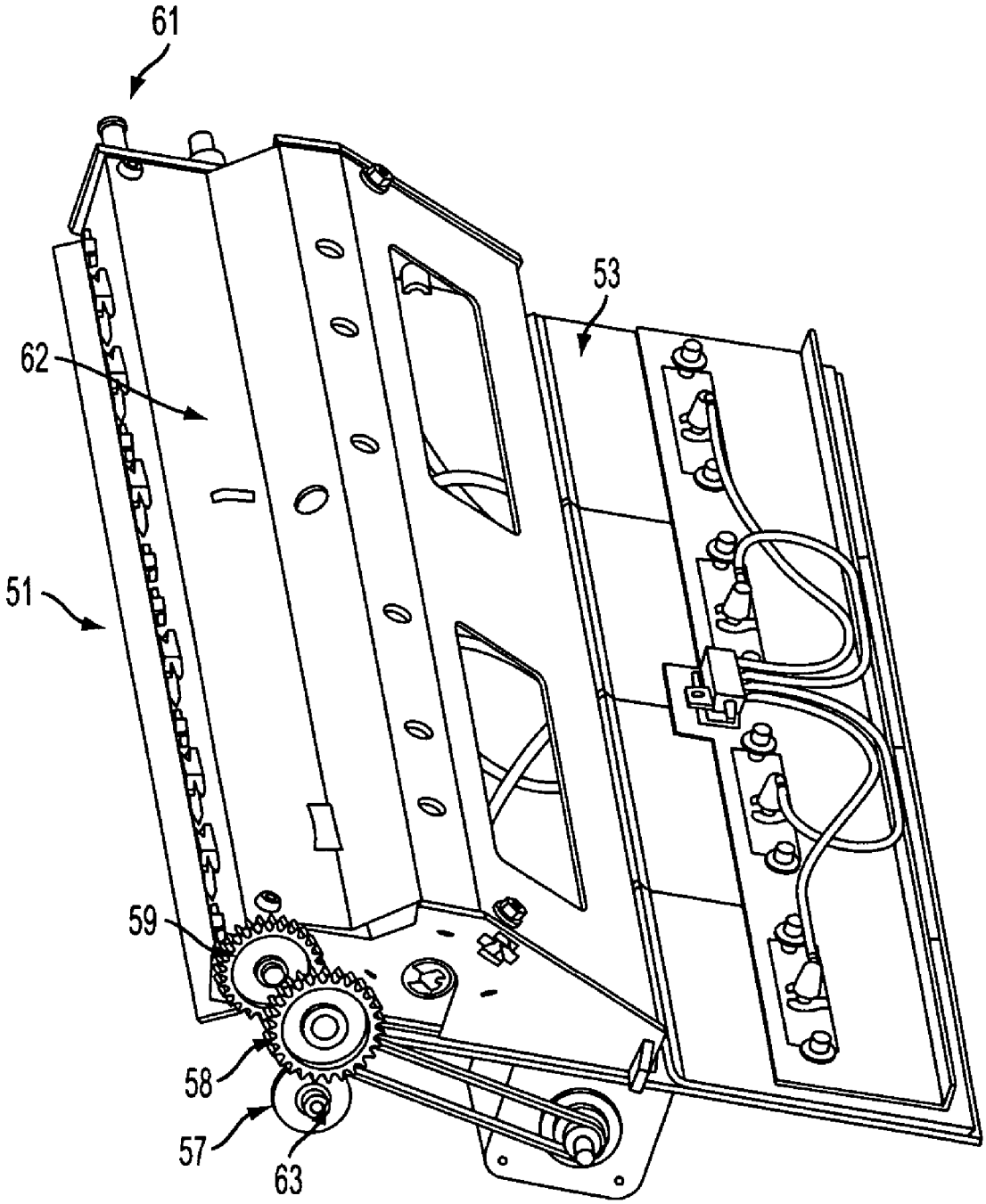
FIG. 6 is a schematic perspective representation of an opening/closing mechanism according to embodiments herein.
Figure 7:
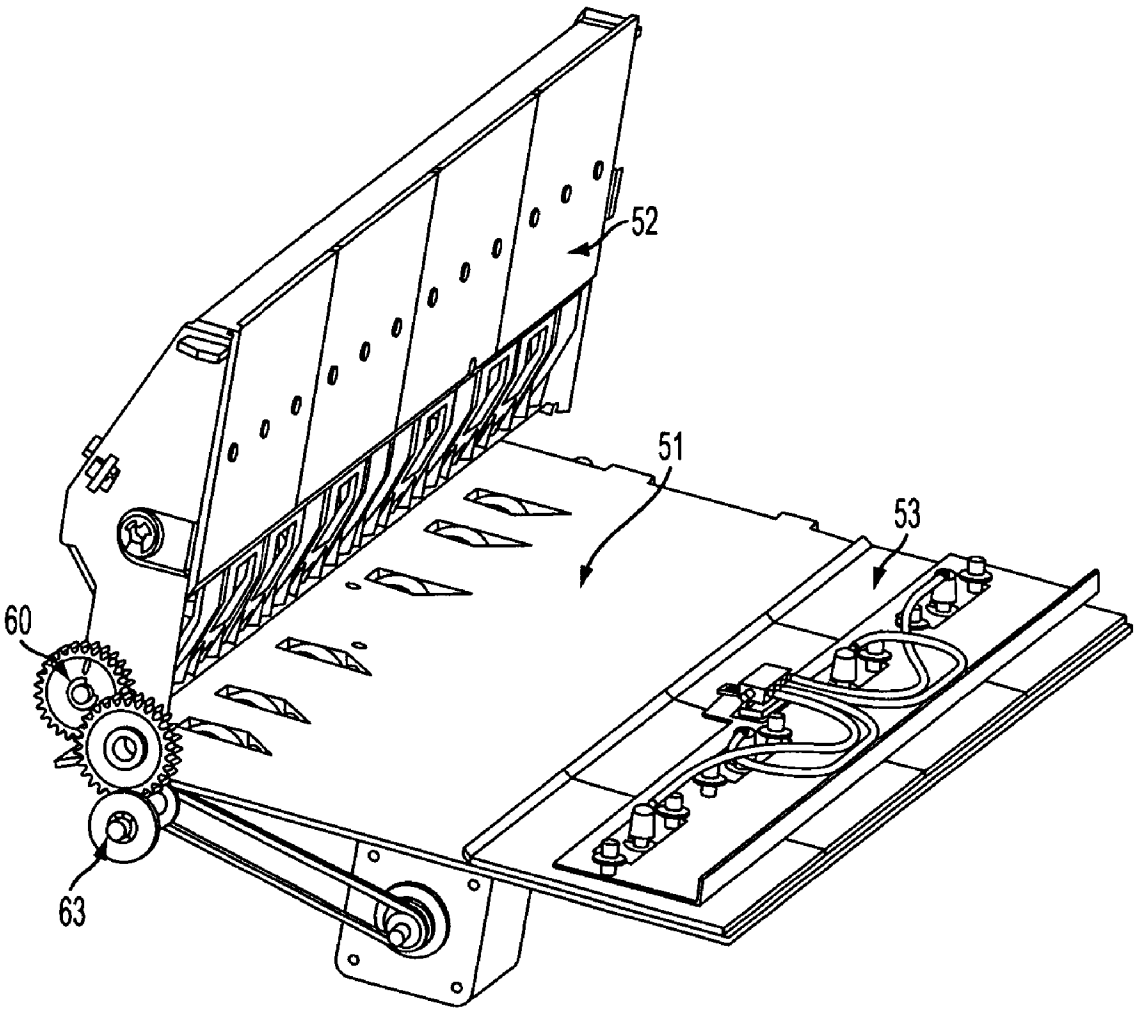
FIG. 7 is a schematic perspective representation of an opening/closing mechanism according to embodiments herein.

The reverse motion of the drive motor can also be used to open the jam clearance mechanism or baffle, as shown in the embodiments illustrated in FIGS. 5-7. As mentioned above, when the nip drive motor is only used to drive the nip in a single forward direction, the jam clearance mechanism according to embodiments herein can be driven open using the reverse motion of the nip drive. This structure/method allows the jam clearance mechanism to be changed from the closed state (for media transport) to the open state any time the nip drive would otherwise be inactive. In the embodiments shown in FIGS. 5-7, a one-way roller clutch or a swing arm apparatus is utilized in order to drive the jam clearance mechanism or baffle open during nip drive motor reverse operation. During forward drive motor operation, the roller clutch or swing arm prevents the jam clearance mechanism from being driven, such that normal nip drive is achieved without disturbing the state of the jam clearance release mechanism. More specifically, FIGS. 5 and 6 show an example portion of a media path with the jam clearance mechanism in the closed state. FIG. 7 shows the same portion of a media path with the jam clearance mechanism in the open state.

As shown in FIGS. 5-7, a media path is formed by a lower baffle (51) and upper baffles (52) and (53). Media is driven through the media path by a drive roller assembly (54) which may have one or more drive nips. The drive roller assembly is driven by a timing pulley and belt (55) that is in turn powered by a motor (56). Alternatively, the drive roller assembly could be driven by a geartrain or could be directly attached to the drive motor.

The upper baffle (52) is part of the jam clearance mechanism (62) which may or may not also contain idler rollers that bear against drive roller assembly (54). The jam clearance mechanism (62) pivots about pin joints (60) and (61). One ordinarily skilled in the art would understand that any form of jam clearance mechanism/opening baffle or means could be utilized with the embodiments herein and the structure shown in FIGS. 5-7 is merely another example of an application of how the embodiments herein can be applied. The embodiments herein may be easily implemented with alternate means of jam clearance opening functionality. For instance, the jam clearance mechanism could slide out of the way, rather than pivot.

In this embodiment, the jam clearance mechanism (62) is directly coupled to the jam clearance pivot gear (59), which is driven by gears (57-58). Gear (57) is fastened to a roller clutch (63). The roller clutch is oriented such that forward rotation of the drive roller (in the media drive direction) does not act on gear (57), but rather acts as a roller bearing. Reverse rotation of the driver roller will lock the roller clutch such that the gear (57) is driven in order to open the jam clearance mechanism (62) via gears (57-59). Different methods may be used to only drive the jam clearance mechanism (62) when the drive roller is driven in reverse (such as a swing arm mechanism).

In order to hold the jam clearance mechanism (62) in the open position, the drive roller (54) can be held in position in order to prevent the mechanism closing under its own weight. In order to close the jam clearance mechanism (62), the drive roller (54) can be driven forward, allowing the mechanism to close under its own weight.

One feature of embodiments herein is that only one motor is required to both drive the nip in the forward direction and control the locking/power opening of the paper path baffle in the reverse direction, thereby eliminating at least one handle/latch/actuator and the user intervention that would otherwise be required to lock/unlock or open/close a baffle for jam clearance. The embodiments herein are especially useful for printing devices that have multiple jam clearance locations. If the media path sensors within the printer are able to locate the jam, the embodiments herein can be used to automatically unlock and open the proper baffle. This could prevent the customer from accessing the wrong baffle during a jam clearing operations (which could potentially disturb upstream or downstream media jobs).

The embodiments herein are also useful where the media path is heated to an unpleasant or unsafe temperature for customer contact. The automatic locking/unlocking and opening/closing of the baffle allows the printer software to keep the media path locked for customer protection during cool down prior to allowing the customer to attempt to remove the jammed media.

The embodiments herein are useful in the case involving a differential drive registration system. See U.S. Pat. Nos. 5,678,159; 4,971,304; 4,438,917; 5,169,140; and 5,278,624 (the complete disclosures of which are incorporated herein by reference) for examples of differential drive registration systems. Differential drive registration systems utilize two coaxial drive nips, which may be driven by two separate drive motors. The reverse motion of one drive motor can be used to unlock the jam clearance mechanism. The reverse motion of the other drive motor can then be used to open the jam clearance mechanism. Thus, the drive motor 84 shown FIG. 8 (discussed below) is intended to schematically illustrate more than one drive motor, each of which could be used to drive separate devices, such as differential drive nips 83, or other devices, where the reverse motion of one motor is used to unlock or lock the baffle and the reverse motion of the other motor is used to open or close the baffle. Further, more than two motors (e.g., three, four, or more motors) could be used to drive various devices, and the reverse motion of each could be used to individually control locking, unlocking, opening, closing, etc. of the baffle or shield.

The embodiments herein are also useful in the case of a drive nip loading camshaft, as described in co-pending U.S. patent application Ser. No. 11/187,747, the complete disclosure of which is incorporated herein by reference. In this patent application, the cam lock gears described above can easily be integrated into the nip loading camshaft, such that the reverse motion of the same drive motor can be used to control nip loading as well as locking/unlocking of the jam clearance mechanism. Thus, the drive nip loading camshaft can be part of the media transport element 83 shown in FIG. 8 (discussed below) and can use the reverse motion of the drive motor to rotate the camshaft, which loads or unloads the nips in the nip drive 83 as well as to lock or unlock the baffle.

Figure 8:
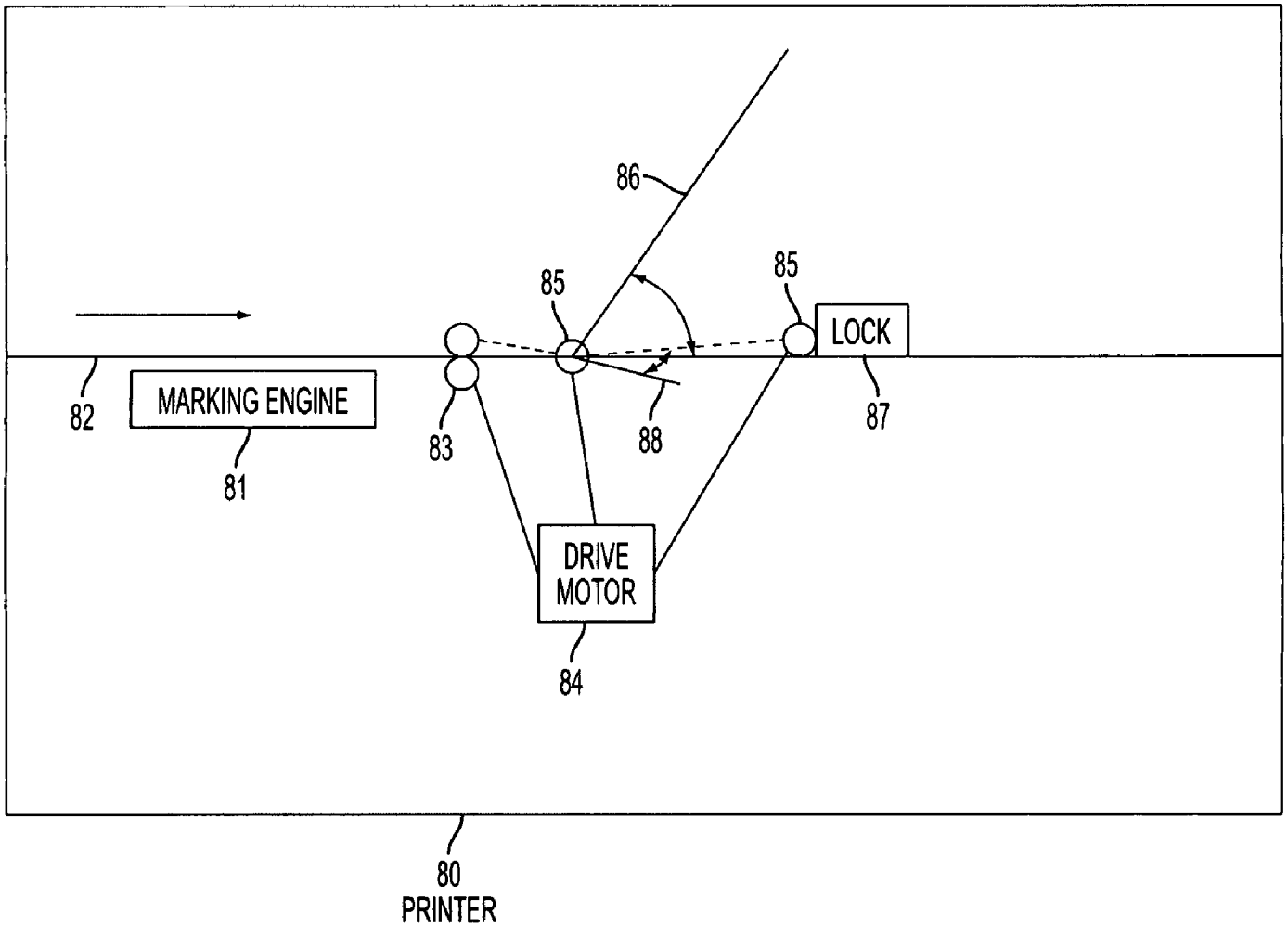
FIG. 8 is a schematic perspective representation of a locking, opening/closing, and shielding mechanism according to embodiments herein.

Thus, embodiments herein comprise, as generally shown in FIG. 8, an image output device 80 such as a printer, copier, facsimile machine, multifunction device, etc., that includes a marking engine 81 and a media path 82 adjacent the marking engine such as that discussed in U.S. Pat. No. 6,032,004, the complete disclosure of which is fully incorporated herein by reference. The media path 82 has a media transportation direction (indicated by arrow) and a media transport element 83 (e.g., a nip drive, a belt drive, a suction drive, an air pressure drive, etc.) within the media path 82 that moves the media along the media path in the media transportation direction. A drive motor 84 is operatively connected to the media transport element 83. The drive motor 84 provides drive force in a forward direction that causes the media transport element 83 to move media along the media path in the media transportation direction. The drive motor 84 can also provide the drive force in a reverse direction opposite the forward direction. A one-way drive transfer device 85 (e.g., a one-way clutch, a one-way swing arm mechanism, etc.) is operatively connected to the drive motor 84 either directly or indirectly through elements of the media transport element 83 (as indicated by the dashed lines). The one-way drive transfer device 85 only transfers drive force from the drive motor 84 to the one-way drive transfer device 85 when the drive motor 84 operates in the reverse direction.

In one embodiment, the media path 82 can include an access element 86 (e.g., a movable baffle, a movable media guide, a movable tray, a movable shield, a movable media jam clearance mechanism, etc.) operatively connected to the one-way drive transfer device 85. Such an access element 86 can allow the media to be removed from an interior of the media path 82 (e.g., a location between the beginning and end of the media path). When the access element 86 is closed, the media can move along the media path 82, and when the access element 86 is open the media potentially cannot move along the media path 82. When the drive motor 84 operates in the reverse direction, the one-way drive transfer device 85 causes the access element 86 to open and/or close, thereby eliminating the need for a separate actuator to move the access element 86. In alternative embodiments, the same or another one-way drive transfer device 85 can cause the access element 86 to lock and/or unlock by operating a lock 87. In a further embodiment, when the drive motor 84 operates in the reverse direction, the one-way drive transfer device 85 can potentially simultaneously cause the access element 86 and a movable shield 88 to open and/or close. The shield 88 could be in place to keep high-temperature and/or sharp objects from being accessed by the user.

The word printer, printing device, image output terminal, etc. as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004. The following claims can encompass embodiments that print in monochrome or color or handle color image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus comprising:

a media path having a media transportation direction;

a media transport element within said media path, wherein said media transport element is adapted to move media along said media path in said media transportation direction;

a drive motor operatively connected to said media transport element, wherein said drive motor is adapted to provide drive force in a forward direction that causes said media transport element to move said media along said media path in said media transportation direction, and provide said drive force in a reverse direction opposite said forward direction; and a one-way drive transfer device operatively connected to said drive motor, wherein said one-way drive transfer device only transfers said drive force from said drive motor when said drive motor operates in said reverse direction, wherein said media path includes an access element operatively connected to said one-way drive transfer device, wherein said access element is adapted to allow jammed media to be removed from an interior of said media path, and wherein when said drive motor operates in said reverse direction, said one-way drive transfer device causes said access element to open and when said drive motor operates in said forward direction, the one-way transfer device causes said access element to close.

2. The apparatus according to claim 1, wherein said media transport element comprises a differential drive registration system having a plurality of co-axial drive nips.

3. The apparatus according to claim 1, wherein said media transport element comprises one of a nip drive, a belt drive, a suction drive, and an air pressure drive.

4. The apparatus according to claim 1, wherein said one-way drive transfer device comprises one of a one-way clutch and a one-way swing arm mechanism.

5. The apparatus according to claim 1, wherein said access element comprises one of a movable baffle, a movable media guide, a movable tray, a movable shield, and a movable media jam clearance mechanism.

6. An apparatus comprising:

a media path having a media transportation direction;

a media transport element within said media path, wherein said media transport element is adapted to move media along said media path in said media transportation direction;

a drive motor operatively connected to said media transport element, wherein said drive motor is adapted to provide drive force in a forward direction that causes said media transport element to move said media along said media path in said media transportation direction, and provide said drive force in a reverse direction opposite said forward direction; and a one-way drive transfer device operatively connected to said drive motor, wherein said one-way drive transfer device only transfers said drive force from said drive motor when said drive motor operates in said reverse direction, wherein said media path includes an access element operatively connected to said one-way drive transfer device, wherein said access element is adapted to allow jammed media to be removed from an interior of said media path, and wherein when said drive motor operates in said reverse direction, said one-way drive transfer device causes said access element to unlock, and when said drive motor operates in said forward direction, said one-way drive transfer device causes said access element to lock.

7. The apparatus according to claim 6, further comprising a differential drive registration system within said media path, wherein said differential drive registration system comprises said drive motor and a second drive motor connected to a second one-way drive transfer device, wherein when said second drive motor is operated in said reverse direction, said second one-way drive transfer device causes said access element to one of open and close.

8. The apparatus according to claim 6, further comprising a nip loading camshaft connected to said drive motor, wherein when said drive motor is operated in said reverse direction, said one-way drive transfer device rotates said camshaft to cause nip loading.

9. The apparatus according to claim 6, wherein said access element comprises one of a movable baffle, a movable media guide, a movable tray, a movable shield, and a movable media jam clearance mechanism.

10. The apparatus according to claim 6, wherein when said access element is closed said media can move along said media path, and wherein when said access element is open said media potentially cannot move along said media path.

11. An apparatus comprising:

a media path having a media transportation direction;

a media transport element within said media path, wherein said media transport element is adapted to move media along said media path in said media transportation direction; and a drive motor operatively connected to said media transport element, wherein said drive motor is adapted to provide drive force in a forward direction that causes said media transport element to move said media along said media path in said media transportation direction, and provide said drive force in a reverse direction opposite said forward direction;

a one-way drive transfer device operatively connected to said drive motor, wherein said one-way drive transfer device only transfers said drive force from said drive motor when said drive motor operates in said reverse direction; and a movable shield operatively connected to said one-way drive transfer device, wherein said media path includes an access element operatively connected to said one-way drive transfer device, wherein said access element is adapted to allow jammed media to be removed from an interior of said media path, and wherein when said drive motor operates in said reverse direction, said one-way drive transfer device simultaneously causes said access element and said movable shield to open, and when said drive motor operates in said forward direction, said one-way drive transfer device causes said access element and said movable shield to close.

12. The apparatus according to claim 11, wherein said media transport element comprises one of a nip drive, a belt drive, a suction drive, and an air pressure drive.

13. The apparatus according to claim 11, wherein said one-way drive transfer device comprises one of a one-way clutch and a one-way swing arm mechanism.

14. The apparatus according to claim 11, wherein said access element comprises one of a movable baffle, a movable media guide, a movable tray, and a movable media jam clearance mechanism.

15. The apparatus according to claim 11, wherein when said access element is closed said media can move along said media path, and wherein when said access element is open said media potentially cannot move along said media path.

* * * * *